US007416153B1

(12) United States Patent
Dervin

(10) Patent No.: US 7,416,153 B1
(45) Date of Patent: Aug. 26, 2008

(54) TELESCOPIC TOILET PAPER HOLDER

(76) Inventor: Bernard Michael Dervin, 19504 Meadowbrook Dr., Bend, OR (US) 97702

( * ) Notice: Subject to any disclaimer, the term of this patent is extended or adjusted under 35 U.S.C. 154(b) by 0 days.

(21) Appl. No.: 11/710,771

(22) Filed: Feb. 26, 2007

(51) Int. Cl.
*B65H 16/06* (2006.01)
*B65H 18/04* (2006.01)

(52) U.S. Cl. ..... 242/599.1; 242/599.3; 242/599.4

(58) Field of Classification Search ..... 242/599.1, 242/599.3, 599.4
See application file for complete search history.

(56) References Cited

U.S. PATENT DOCUMENTS 2,876,960 A * 3/1959 Glaner ..... 242/599.1
3,145,940 A * 8/1964 Henry ..... 242/599.2
4,373,682 A * 2/1983 Dickson ..... 242/564
5,340,047 A * 8/1994 Heller ..... 242/599.1

* cited by examiner

*Primary Examiner*—Evan H Langdon

(57) ABSTRACT

The present invention relates to an improved telescopic toilet paper roll holder which substantially deadens the sound of a roll of toilet paper while being rotated; self-aligns and snuggly holds either a uniform or misshaped roll of toilet paper in place, preventing axial play and mutilation of the paper edges; produces a slight drag while being rotated, preventing paper runaway. This improved holder is comprised of a foamed polymer tube encompassing two hollow cylinders having slightly different diameters, nested together through their inside ends and supporting felt covered pintles on their outside ends, with a helical compression spring inside the larger cylinder urging both cylinders to extend axially; cylinders are provided with a protuberant to keep them from coming apart.

7 Claims, 1 Drawing Sheet

FIG. 1
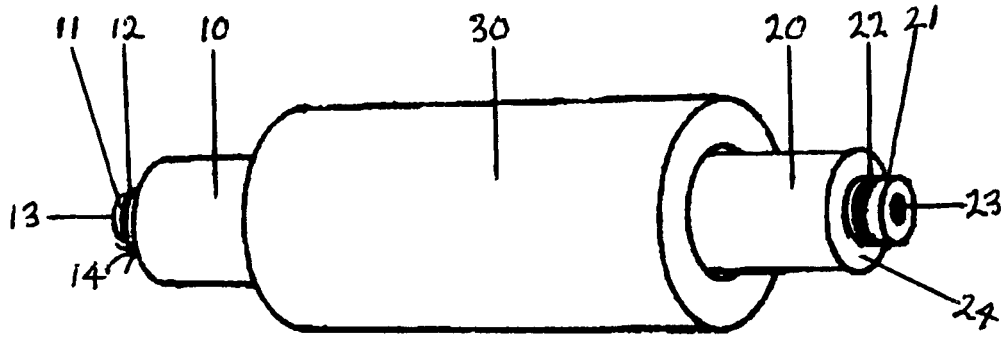
FIG. 2
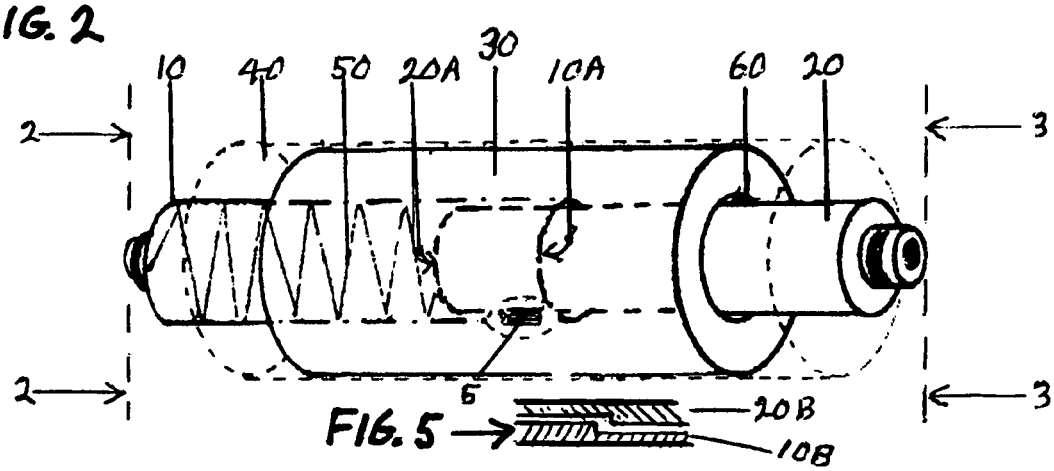
FIG. 5
FIG. 3
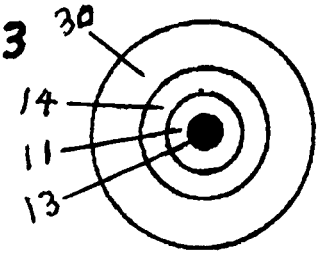
FIG. 4
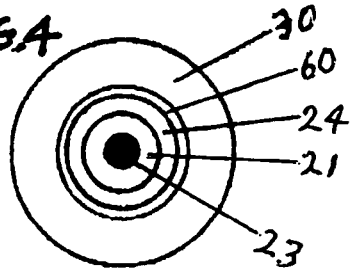

TELESCOPIC TOILET PAPER HOLDER

REFERENCES CITED

| | | |
|---|---|---|
| 1557700 | October 1925 | Jaderlund |
| 2522109 | September 1950 | Foltis |
| 2571321 | October 1951 | Wettley |
| 2602601 | July 1952 | Balz |
| 2889122 | June 1959 | McConnell |
| 3037718 | June 1962 | Pettit |
| 3170652 | February 1965 | Kennedy |
| 3516615 | June 1970 | Wickenberg |
| 3643884 | February | Cur |
| 3799465 | March 1974 | Erny |
| 4015788 | April 1977 | O'Conner |
| 4285474 | August 1981 | Perez |
| 5340047 | August 1994 | Heller |
| 6557797 | May 2003 | Bonamarte |
| 7101441 | September 2006 | Kennard |

BACKGROUND OF THE INVENTION

Recessed toilet paper roll wall receptacles have assumed an almost universal appearance and simple structure, with opposed trunnions containing bearing holes to accommodate telescopic holders of a standard roll of toilet paper approximately 4.5 inches long by 4.5 inches in diameter with a center hole core of approximately 1.5 inches. These receptacles are only partially recessed in a wall so that the trunnion bearing holes are located on the room side of a wall surface to simplify inserting a holder containing a standard roll of toilet paper.

Telescopic toilet paper holders have also assumed almost universal appearance and simple structure to accommodate a standard roll of toilet paper. They are comprised of two hollow cylinder members having slightly different diameters, nested together through their open ends and partially closed on their outside ends to support pintles. They are approximately 1 inch in diameter and have the capability to expand from approximately 4.5 inches to 5.75 inches. A helical compression spring inside one of the cylinders urges both cylinders to extend axially. The cylinder members are provided with a protuberant to keep them from coming apart.

The problem with paper roll holders of the foregoing type us that they loosely journal and support a roll of toilet paper of the present era (made with relatively thin soft cardboard cores) because the outside diameter of the holder is approximately 50% smaller than the inside diameter of the core of a roll of toilet paper. Because of these impediments: it is a common experience to hear excessive noise when a misshaped or damaged roll of toilet paper is being unwound, resulting in mutilation of paper edges and paper runaway due to axial play; when someone pulls paper from a roll after fifty percent or more of a misshapen paper roll has been dispensed the roll is subject to paper runaway, resulting in a fast and noisy clattering sound of the paper core rotating around the holder, while the holder itself rotates very slowly on its pintles or remains fixed.

BRIEF SUMMARY OF THE INVENTION

A toilet paper holder comprised of two telescoped hollow cylinder members encircled by a flexible foamed polymer tube; each cylinder member having an inside and outside end. The first cylinder member is affixed to the foamed polymer tube. Said tube extends from the affixed encircled first cylinder member in the manner of a cantilever to the un-affixed encircled second cylinder member; the second cylinder member slides through the bore of the foamed polymer tube and into the bore of the first cylinder member. The outside ends of both cylinder members are provided with cylindrical pintles. The circumferential surface of the pintles are encircled with felt strips and felt disks are attached to the ends of the pintles. A helical compression spring inside the first cylinder member urges both cylinder members to extend axially.

The outside diameter of the flexible foamed polymer tube which encompasses the telescopic cylinder members, is slightly larger than the inside diameter of a standard toilet paper core so that a roll of paper can be held in a snug position on the holder by the expansive force of the foamed polymer member. This diameter difference does not cause any undue effort in loading a roll of paper, which can be slightly tilted on the holder because of the pliability of the foamed polymer.

The resilient foamed polymer encircled telescoped members and felt surfaced pintle members, substantially deadens the sound of a roll of toilet paper while being rotated. The noise factor becomes and embarrassing irritant to the user when dispensing from a recessed fixture located in an interior wood frame/sheet rock wall assembly; many or these assemblies sound like sounding boards.

The flexible foamed polymer member self-aligns and snuggly holds a misshaped or uniform roll of toilet paper in place which: prevents axial play; mutilation of the paper edges; prevents paper runaway by producing a slight drag during rotation of a roll.

The device of the invention is simple in construction, efficient and time saving in operation, and lends itself to convenient and economical manufacture.

While the foregoing specification embodiments of the invention have been described in considerable detail for purposes of making a complete disclosure thereof, it will be apparent to those skilled in the art that numerous changes may be made in such details without departing from the spirit and principles of the invention.

The aforementioned information with other objects of the present invention will be described in greater detail in the remainder of the specification referring to the drawings.

BRIEF DESCRIPTION OF THE DRAWINGS

FIG. 1 is a front perspective view of a toilet paper holder embodying the principles of the present invention;

FIG. 2 is an isometric front view of the holder shown in FIG. 1;

FIG. 3 is an end view along the lines of 2-2 of the holder of FIG. 2;

FIG. 4 is an end view along the lines of 3-3 of the holder of FIG. 2;

FIG. 5 is a detailed view of area 5 of FIG. 2.

DETAILED DESCRIPTION OF THE INVENTION

Referring to FIG. 1

To achieve substantial sound reduction and paper control, paper holder is comprised of telescoped hollow cylinder members 10 and 20 encircled by foamed polymer tube 30; cylinder members 10 and 20 are closed on their outside ends 14 and 24 to support cylindrical pintles 11 and 21; the circumferential surface of pintles 11 and 21 are encircled with felt strips 12 and 22, and the ends of pintles 11 and 21 are provided with felt disks 13 and 23.

Referring to FIG. 2

So that the insertion of a full roll of toilet paper may be accomplished with equal ease and quickness, foamed polymer tube 30 has been made shorter than the length of a standard toilet paper core 40, enabling the fingers of ones hand to be inserted at either end of the toilet paper holder, in the space between either cylinder member 10 and polymer tube 30, or the space between cylinder member 20 and polymer tube 30; the larger space 60 between cylinder member 20 and polymer tube 30 allows a slight tilting of the nested cylinder members 10 and 20.

Flexible foamed polymer tube 30 encircles cylinder members 10 and 20. Tube 30 is adhered to cylinder member 10. Cylinder member 20 is slidable through polymer tube 30 and the open inside end 10A and is telescopically nested within cylinder member 10. The inside end 20A of cylinder member 20 is partially closed to restrain helical compression spring 50, mounted between the outside end of cylinder member 10 and the inside end of cylinder member 20. Spring 50 exerts a longitudinal force, which urges both cylinders 10 and 20 to extend axially.

To prevent the telescoped cylinder members from pulling apart cylinder member 10 is provided with an internal ridge 10B and cylinder member 20 is provided with and external ridge 20B.

Referring to FIG. 3

An end view 14 of cylinder member 10, showing end views of polymer tube 30, pintle 11 and felt disk 13.

Referring to FIG. 4

An end view 24 of cylinder member 20, showing end views of polymer tube 30, pintle 21, felt disk 23 and space 60 between cylinder member 20 and polymer tube 30.

Referring to FIG. 5

Cylinder members 10 and 20 are shown with an internal annular ridge 10B and external annular ridge 20B, respectively. The ridges 10B and 20B prevent cylinder members 10 and 20 from coming apart.

The invention claimed is:

1. A paper holder comprising: an open ended flexible foamed polymer tube encircling first and second telescopic hollow cylinder members having ends which respectfully extend from the axial ends of said tube; said polymer tube is adhered to said first cylinder member; said second cylinder member being telescopically slidable through the bore of said polymer tube and into the bore of said first cylindrical member; said first cylinder member is open on the inside end and supports a pintle on the outside end; said second cylinder member is partially closed on the inside end and supports a pintle on the outside end; a helical compression spring inside said first cylinder member urges both said first and second cylinder members to extend axially; to prevent said cylinder members from coming apart said first cylinder member is provided with an internal annular ridge and said second cylinder member is provided with an external annular ridge for engaging said internal annular ridge; wherein said foamed polymer tube encompasses said first and second cylindrical member and the external diameter of said foamed polymer tube is slightly larger that the internal diameter of the core of a standard roll of toilet paper, so that a standard roll of toilet paper is held in place by the expansive force of said polymer tube.

2. The telescopic paper holder of claim 1 wherein support pintles are provided on the outside ends of said first and second cylinder members; the circumferential surface of said pintles are encircled with felt strips and felt disks are attached to the axial ends of such pintles.

3. The telescopic paper holder of claim 1 wherein said foamed polymer tube is shorter than a standard width of a roll of toilet paper, so that the fingers of ones hand can be inserted at either end of said holder in the empty space between said cylinder members and said foamed polymer tube, and if necessary a roll of toilet paper can be slightly tilted on said cylinder member because of the pliability and resiliency of said polymer tube, so that the insertion or removal of a roll of toilet paper may be accomplished with equal ease and quickness.

4. The telescopic toilet paper holder of claim 1 wherein when said holder is inserted into the core of a misshaped roll of toilet paper, the resiliency of the foamed polymer adjusts said holder to the shape of the core and brings the roll of toilet paper into alignment to rotate smoothly and quietly when pulling paper from said roll.

5. The telescopic toilet paper holder of claim 1, wherein the expansive force of said polymer tube prevents axial play when pulling paper from said roll.

6. The telescopic toilet paper holder of claim 1, wherein the expansive force of said polymer tube prevents paper runaway when pulling paper from said roll.

7. The telescopic toilet paper holder of claim 1, wherein the expansive force of said polymer tube deadens sound when pulling paper from said roll.

* * * * *